US008382392B2

(12) United States Patent
Liao

(10) Patent No.: US 8,382,392 B2
(45) Date of Patent: Feb. 26, 2013

(54) MULTI-PURPOSE ADJUSTABLE QUICK EXPANDABLE INSTALLMENT

(76) Inventor: Yeu-Chuan Liao, Taipei (TW)

( * ) Notice: Subject to any disclaimer, the term of this patent is extended or adjusted under 35 U.S.C. 154(b) by 469 days.

(21) Appl. No.: 12/540,827

(22) Filed: Aug. 13, 2009

(65) Prior Publication Data

US 2011/0036019 A1 Feb. 17, 2011

(51) Int. Cl.
*E02D 29/14* (2006.01)

(52) U.S. Cl. ..... 404/26

(58) Field of Classification Search ..... 404/25, 404/26; 52/20; 137/371; 411/16, 17
See application file for complete search history.

(56) References Cited

U.S. PATENT DOCUMENTS

| | | | | | |
|---|---|---|---|---|---|
| 599,441 | A * | 2/1898 | Dorr | 404/26 |
| 638,692 | A * | 12/1899 | Banwell | 404/26 |
| 1,673,145 | A * | 6/1928 | Gschwind | 404/26 |
| 3,611,889 | A * | 10/1971 | Levinson | 404/26 |
| 5,211,504 | A * | 5/1993 | Trudel | 404/26 |
| 5,360,131 | A * | 11/1994 | Phillipps et al. | 220/8 |
| 6,520,713 | B2 * | 2/2003 | Sondrup | 404/26 |
| 6,524,026 | B2 * | 2/2003 | Sondrup | 404/26 |
| 2002/0136604 | A1 * | 9/2002 | Sondrup | 404/26 |
| 2003/0235467 | A1 * | 12/2003 | Gamson | 404/26 |
| 2007/0081857 | A1 * | 4/2007 | Yoon | 404/26 |

* cited by examiner

*Primary Examiner* — Gary S Hartmann
(74) *Attorney, Agent, or Firm* — Muncy, Geissler, Olds & Lowe, PLLC

(57) ABSTRACT

A multi-purpose adjustable quick expandable installment which can be quickly and finely adjusted and ascend or descend freely, by a snap design which adjusts ascending or descending with a slope principle, based on a mechanical principle that a force is constant if acting on a same area and an opposite force compensates with the force. Through a structure which follows the law of action and reaction to compensate with a sliding force which occurs naturally, a stable movement without moving accidentally is formed.

13 Claims, 15 Drawing Sheets

MULTI-PURPOSE ADJUSTABLE QUICK EXPANDABLE INSTALLMENT

BACKGROUND OF THE INVENTION a) Field of the Invention

The present invention relates to a multi-purpose adjustable quick expandable installment, and more particularly to an adjustable expandable installment which can be formed integrally, and can save production cost and manual operation fees, thereby constituting a multi-purpose quick and free ascending and descending or expandable installment.

b) Description of the Prior Art

Ordinarily, expansion between two expandable objects, such as between two slabs, between two cylindrical objects, within an expandable foot stand, within an expandable table leg or within a foldable bicycle, is carried out by external screws, springs, snaps, collars or additional outer sleeves, so as to change height or length between the two objects or to fix the two objects to prevent from sliding.

In addition, an existing manhole cover used on a pavement is covered on a through-hole. As it is unable to adjust height of the manhole cover, when the pavement is re-patched, due to that the pavement should be re-paved with asphalt, the patched pavement will have a difference in height as compared to the original pavement that the patched pavement may be higher or lower than the original pavement.

At this time, as it is unable to adjust the height of the ordinary manhole cover, it will also result in the difference in height between the manhole cover and the re-paved pavement after patching the pavement, causing the pavement to be rough that the pavement may be raised or be provided with pots. This will easily endanger road users; especially that it is a rather severe safety risk to the road users who ride on motorcycles or bicycles.

Accordingly, in order to improve the aforementioned issues, there are manhole covers with adjustable height on market. However, as the conventional manhole structures are very complicated, they are inconvenient in production and are not easily operated. Moreover, their functions are limited in that they cannot perform quick fine-adjustment to the height, and they are also more expensive in cost.

SUMMARY OF THE INVENTION

The primary object of the present invention is to provide a multi-purpose adjustable expandable installment which is able to save production cost and manual operation fees, and perform quick fine-adjustment to the height.

To achieve the aforementioned object, the multi-purpose adjustable quick expandable installment of the present invention includes an outer frame and an inner frame, both of which can be formed integrally. A snap design for ascending and descending adjustment is implemented primarily with slopes between the outer frame and the inner frame, such that the inner frame can quickly ascend and descend in fine-adjustment in the outer frame, thereby achieving an effect that the height of the inner frame can be finely adjusted in the outer frame.

Besides, the present invention can be also combined with the existing manhole cover for use, such that by changing minimally the existing manhole cover, the manhole cover can be assembled with the multi-purpose adjustable quick expandable installment of the present invention. Therefore, cost for replacing the manhole cover can be reduced significantly, and the multi-purpose adjustable quick expandable installment which is provided with economical benefits can be further provided.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
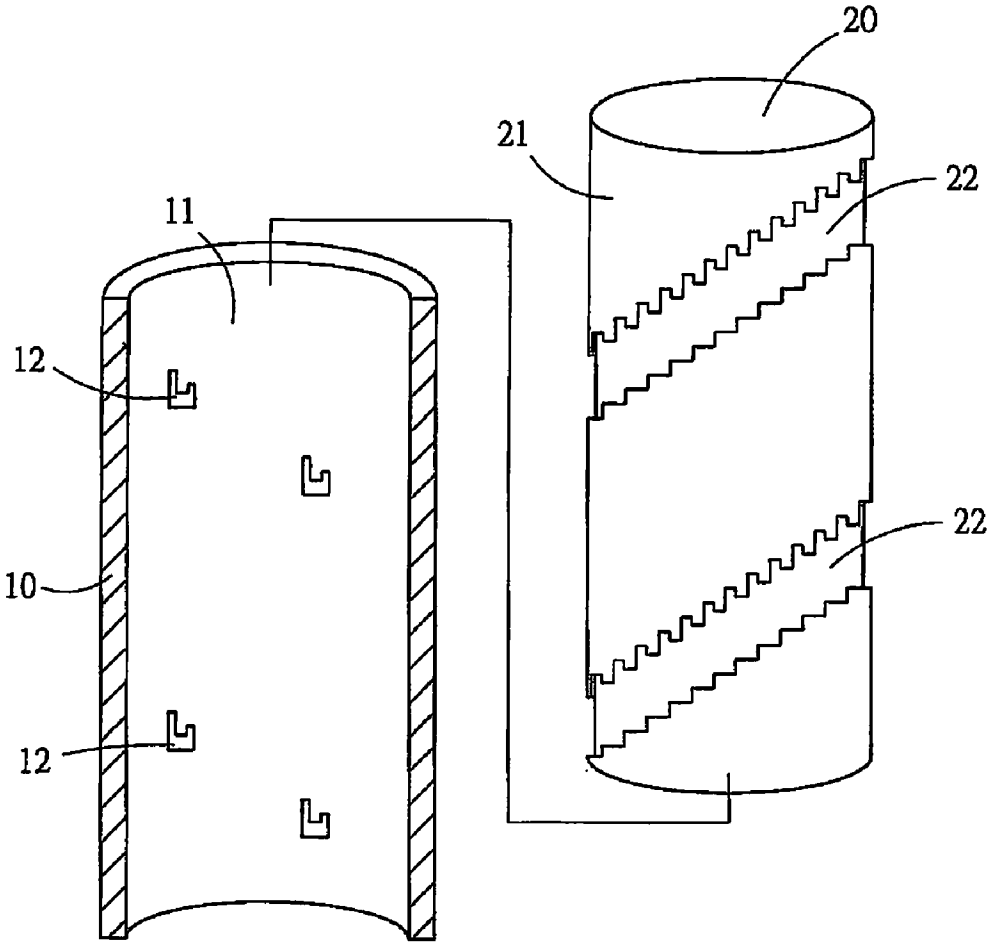
FIG. 1 shows a three-dimensional exploded view of the present invention.
Figure 2:
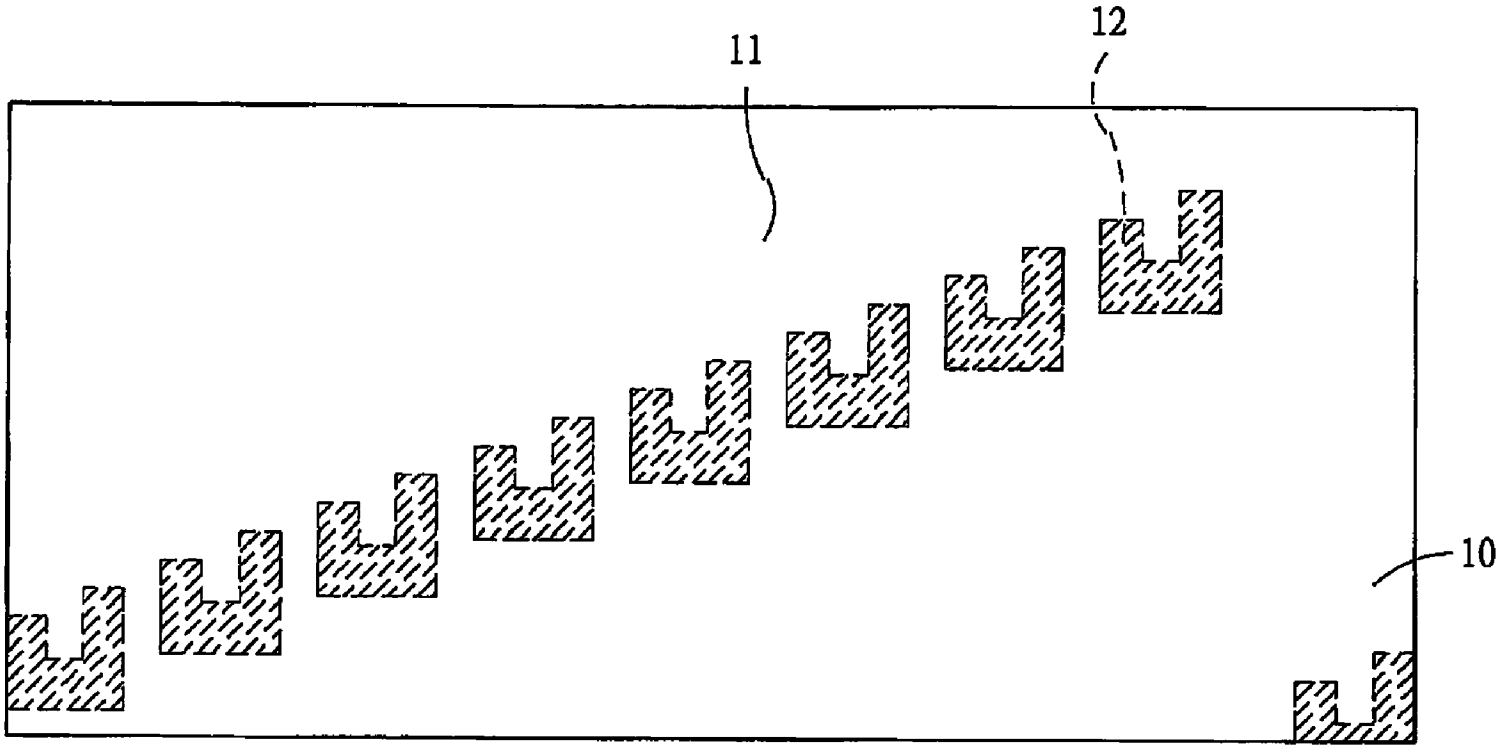
FIG. 2 shows a schematic view of an unfolded outer frame of the present invention.
Figure 3:
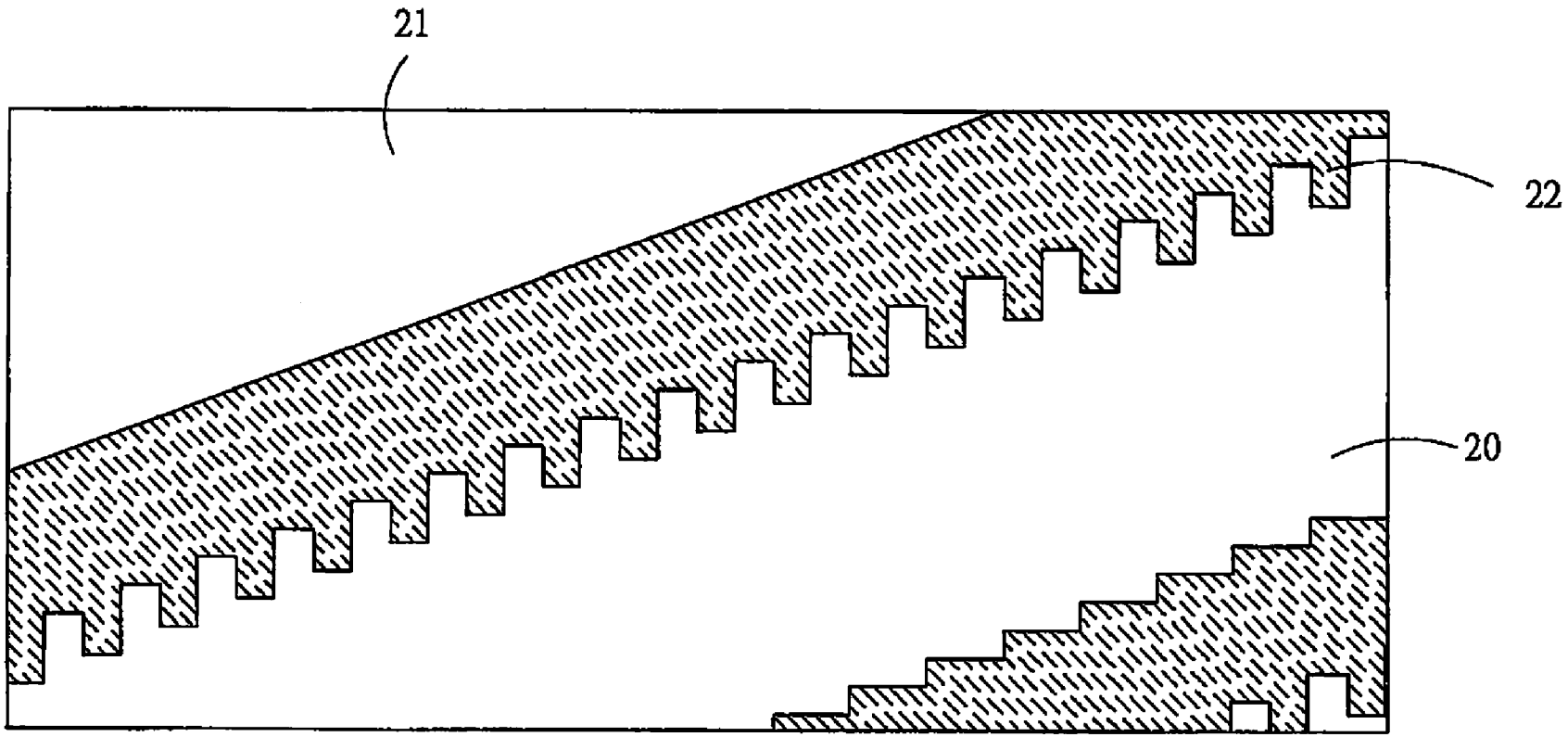
FIG. 3 shows a schematic view of an unfolded inner frame of the present invention.

Referring to FIG. 1, in association with FIG. 2 and FIG. 3, it shows a schematic view of a first embodiment of a multi-purpose adjustable expandable installment of the present invention. The adjustable expandable installment comprises an outer frame 10 and an inner frame 20.

The outer frame 10 can be an integrally formed hollow tube and an inner wall 11 of the hollow tube is provided with plural first type retainers 12 which are protruded from the inner wall 11. In association with FIG. 2 which is an unfolded view of the outer frame 10, the first type retainers 12 are arranged obliquely from low to high on the inner wall 11; whereas on the physical outer frame 10, the first type retainers 12 are arranged helically.

The inner frame 20 also can be formed integrally and can be emplaced in an interior of the outer frame 10. Aside wall 21 of the inner frame 20 is provided with plural second type retainers 22. In association with FIG. 3 which is an unfolded view of the inner frame 20, the second type retainers 22 are also arranged obliquely from low to high on the side wall 21; whereas, on the physical inner frame 20, the second type retainers 22 are arranged helically and correspond to and can be latched with the first type retainers 12.

Figure 4:
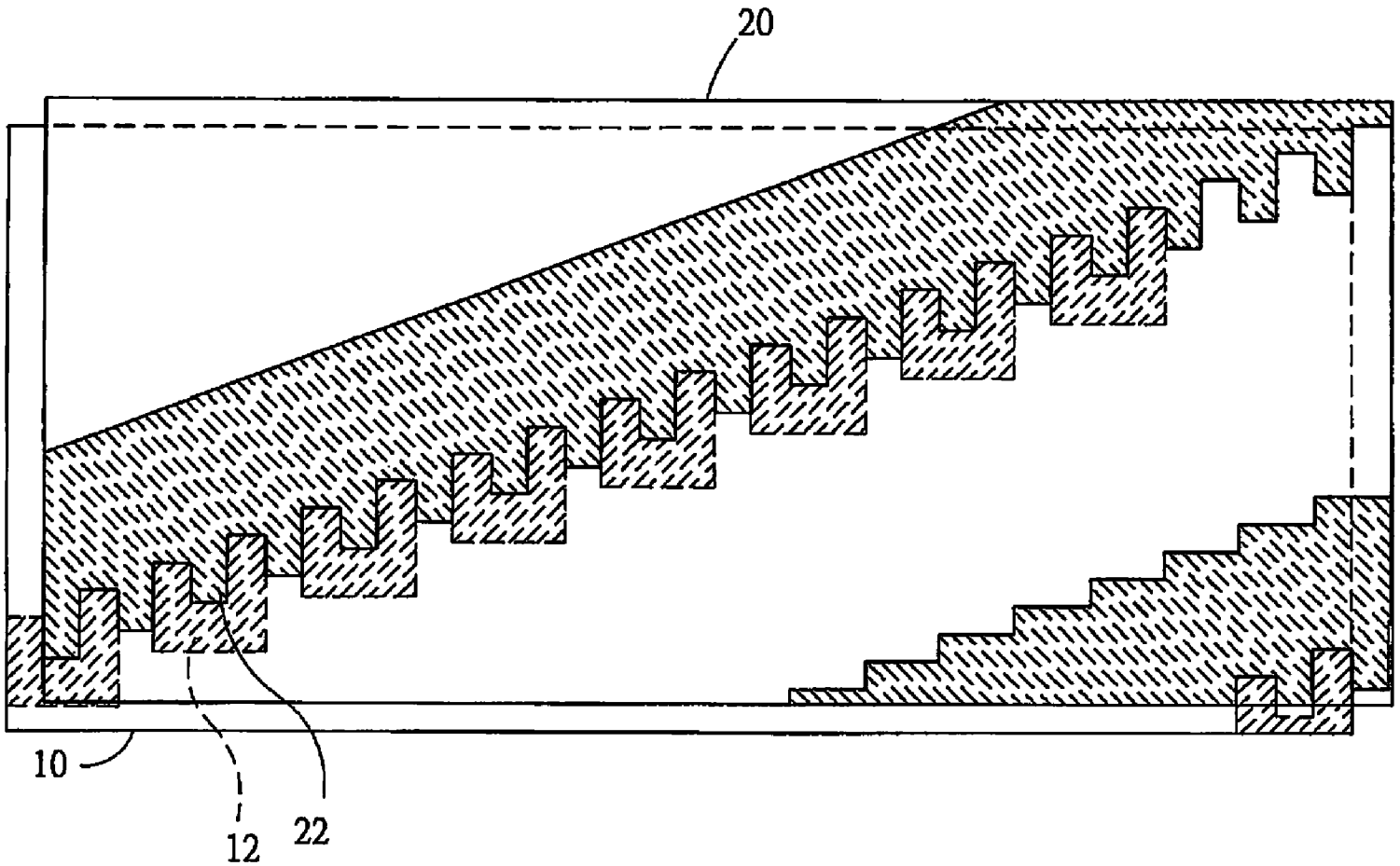
FIG. 4 and FIG. 5 show schematic views of an outer frame and an inner frame of the present invention, which are unfolded and overlapped, disclosing a condition that a relative height between the outer frame and the inner frame is adjusted.
Figure 5:
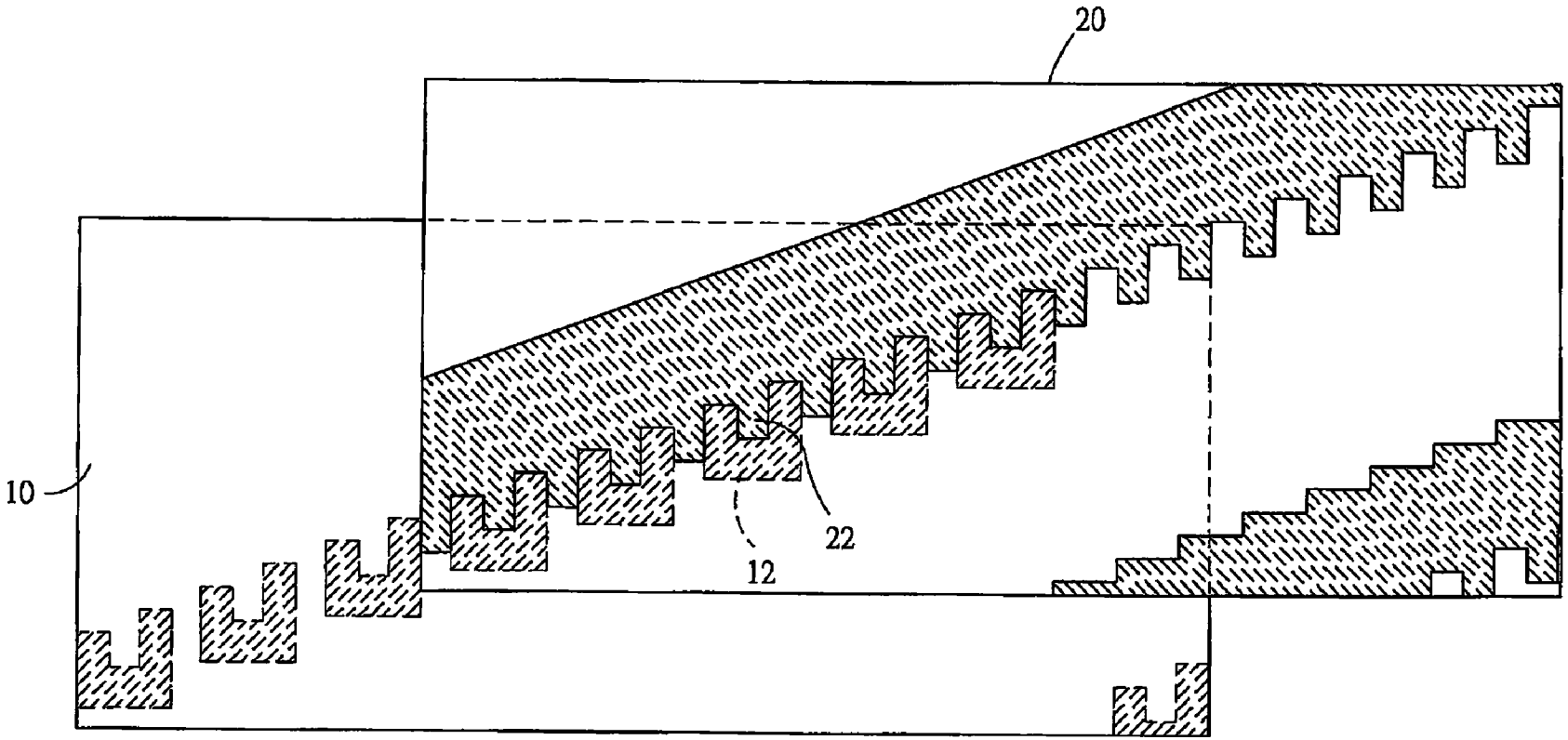

In association with FIG. 4, when the inner frame 20 is emplaced inside the outer frame 10, a relative position and a relative height of the inner frame 20 with respect to the outer frame 10 can be fixed by latching the first type retainers 12 with the second type retainers 22. In addition, in association with FIG. 5, when the inner frame 20 is displaced angularly with respect to the outer frame 10, the first type retainers 12 can be latched with the second type retainers 22 at different levels, such that a finely adjusted ascending or descending movement can be formed to the inner frame 20 with respect to the outer frame 10; that is, when the inner frame 20 rotates with respect to the outer frame 10, the inner frame 20 can ascend or descend accordingly.

The first type retainers 12 and the second type retainers 22 can be in a rectangular shape, a tooth shape or an arc shape. As long as that the first type retainers 12 can be latched with the second type retainers 22, any geometrical shape can apply.

Figure 6:
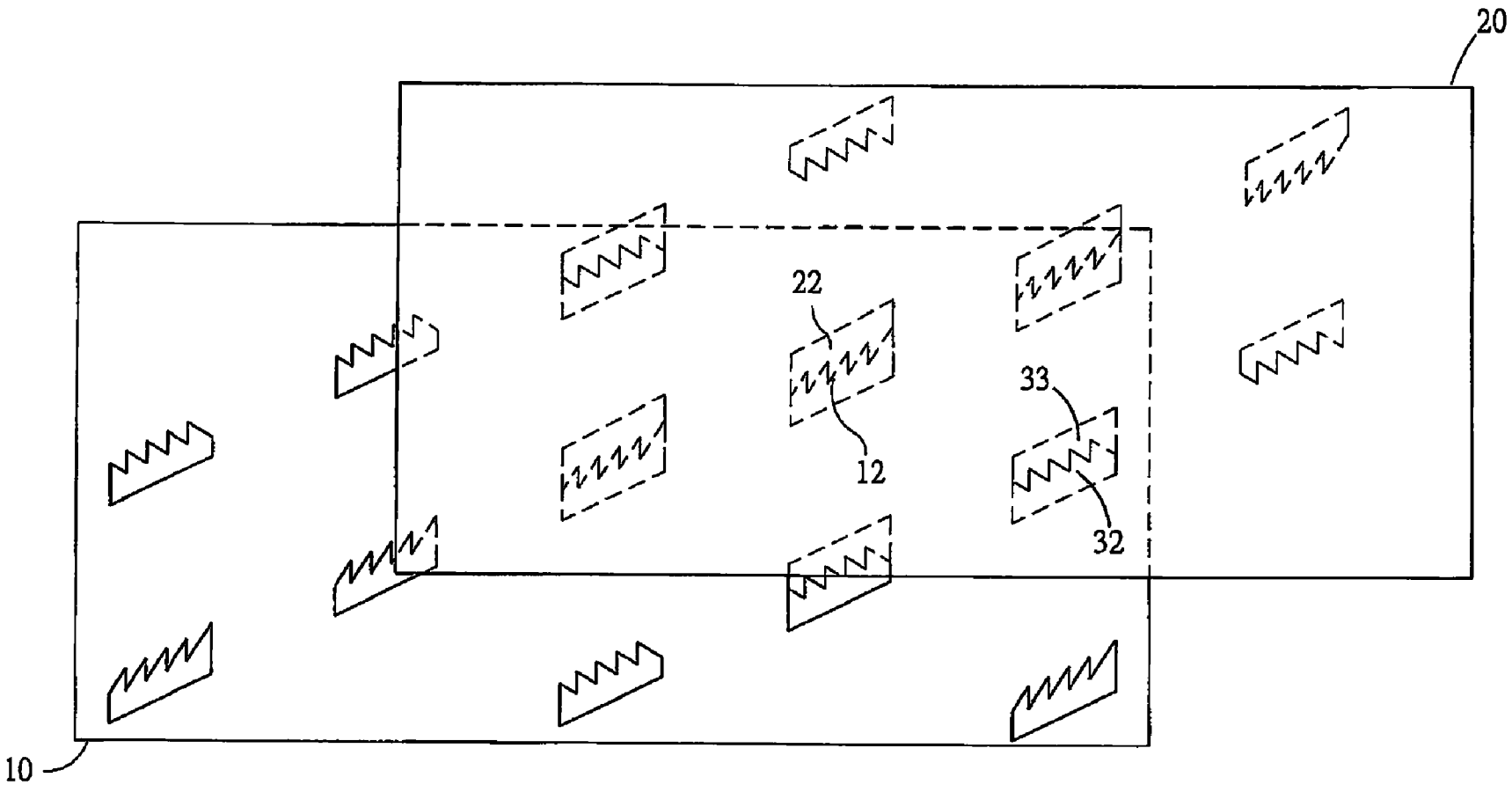
FIG. 6 shows a schematic view of a second embodiment of the present invention, wherein an outer frame and an inner frame are unfolded and overlapped.

On the other hand, as shown in FIG. 6, it shows a schematic view of a second embodiment of the present invention. The first type retainers 12 manifest primarily a saw-tooth design and the second type retainers 22 also manifest a saw-tooth design corresponding to the first type retainers, whereas, the third type retainers 32 and the fourth type retainers 33 manifest an oppositely arranged saw-tooth design, wherein a proper gap can be provided between the neighboring first type retainers 12 and between neighboring third type retainers 32; whereas, a proper gap can be also provided between the neighboring second type retainers 22 and between the neighboring fourth type retainers 33. The gap between the neighboring first type retainers 12 and between the neighboring third type retainers 32 is larger than the size of the second type retainers 22 and the size of the fourth type retainers 33 and the gap between the neighboring second type retainers 22 and between the neighboring fourth type retainers 33 is larger than the size of the first type retainer 12 and the size of the third type retainers 32. This design allows that when the outer frame 10 is assembled with the inner frame 20, each first type retainer 12 and each third type retainer 32 can pass through directly the gap between the neighboring second type retainers 22 and between the neighboring fourth type retainers 33 and each second type retainer 22 and each fourth type retainers 33 can also pass through directly the gap between the neighboring first type retainers 12 and the gap between the neighboring third type retainers 32; whereas, the gap between any two retainers is also larger than the size of that retainer. Accordingly, the outer frame 10 and the inner frame 20 can be quickly assembled to a desired relative height, and then, rotate relatively so that the first type retainers 12 can be latched with the second type retainers 22, thereby accomplishing assembling or adjusting. Furthermore, if the first type retainers 12 and the second type retainers 22 are formed with right-angled triangles, then third type retainers 32 and fourth type retainers 33 are formed with right-angled triangles on opposite oblique surfaces, so as to result in a reaction force to inhibit movement between the outer frame 10 and the inner frame 20, thereby generating a stable force by which the outer frame 10 and the inner frame 20 can be fixed without any accessories.

Figure 7:
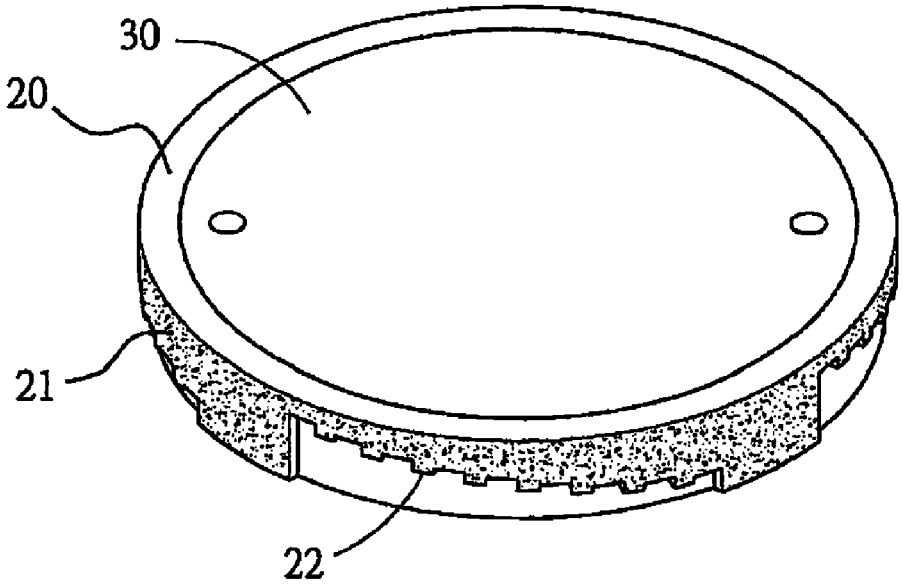
FIG. 7 shows a three-dimensional exploded view of the present invention applying to a circular manhole cover.
Figure 7:
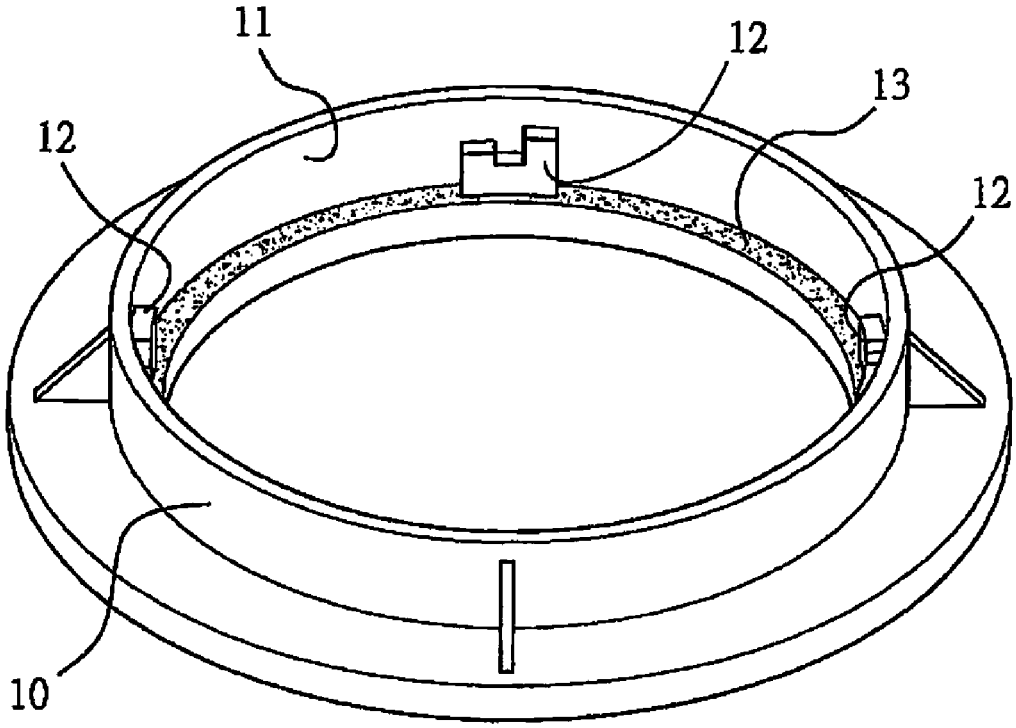

Referring to FIG. 7, it shows a schematic view of a third embodiment of the present invention. When the present invention is applied to an existing circular manhole cover, an inner wall of the inner frame 20 is provided with plural second type retainers 22 which constitute a slope and the top end of the slope does not exceed a proper height of the inner frame 20, with the side wall 21 being attached with a pad to stop water and mud from coming in.

On the other hand, the inner wall 11 of the outer frame 10 is provided with plural individual first type retainers 12, which are fixed on the inner wall 11, the height of the top end does not exceed a proper height of the inner frame 20 and which correspond to the second retainers 22.

Figure 16:
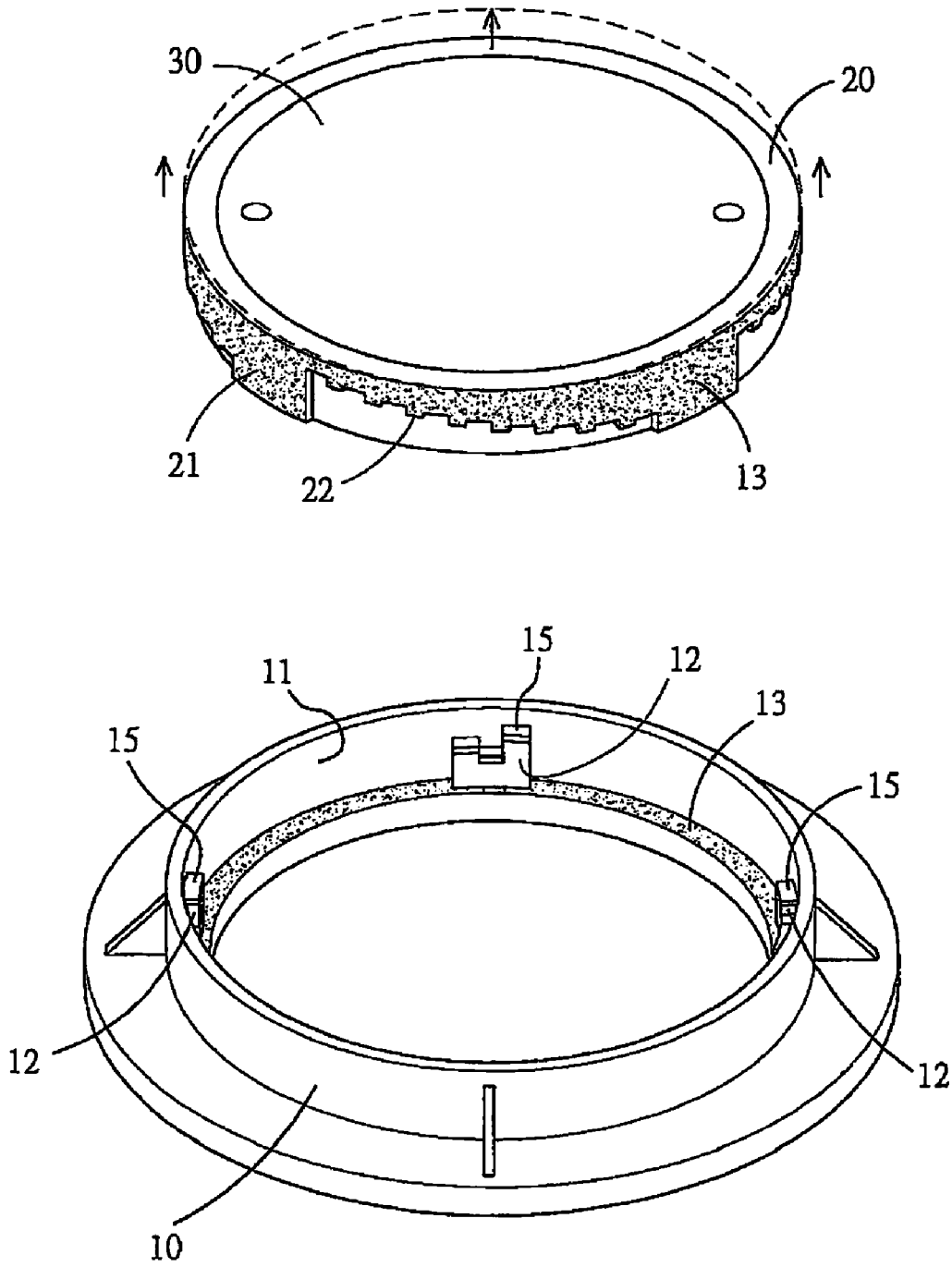
FIG. 16 shows a schematic view of the present invention which is applied in adjusting a circular manhole cover.

When the height needs to be adjusted, it only needs to lift up the inner frame 20 and rotate toward left or right a little that the inner frame 20 can ascend or descend with respect to the outer frame 10 by a change of positions of the first and second type retainers. At this time, as the heights of the two type retainers are only a half or less than a half of a height of the manhole cover, an upper part can keep sealed; that is, water and mud can be prevented from coming in. In addition, a side wall and a lower seat of the outer frame 10 are provided additionally with a pad 13 to block noise and to seal. Referring to FIG. 16 at the same time, by increasing a height of one or plural first type retainers 12, a manhole cover 30 can be tilted to fit with the slope of the ground surface, such that a special tiltable manhole cover can be replaced without wasting a huge manpower and cost, thereby achieving an object of reducing $CO_2$ emission to protect environment.

Figure 9:
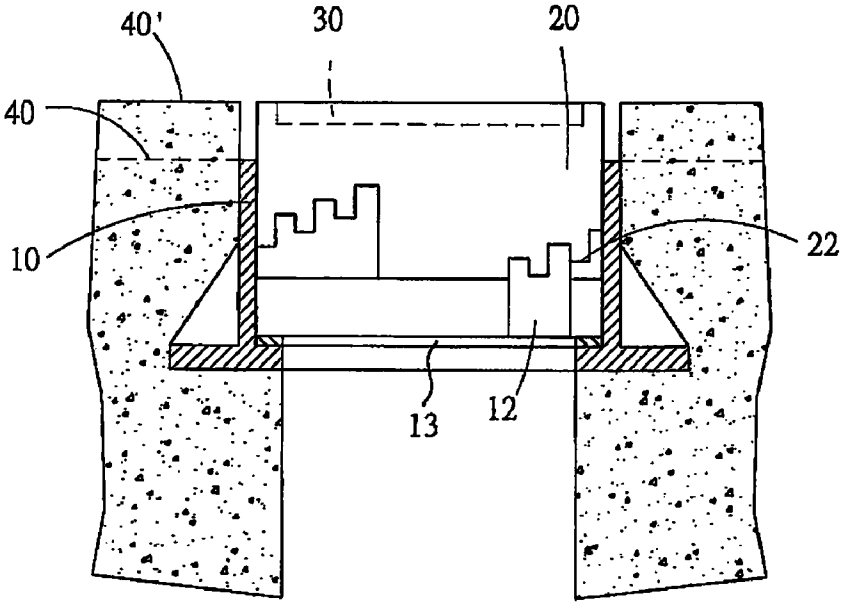
FIG. 8 and FIG. 9 show cutaway views of the present invention which is applied to a circular manhole cover, disclosing conditions of adjustment.
Figure 8:
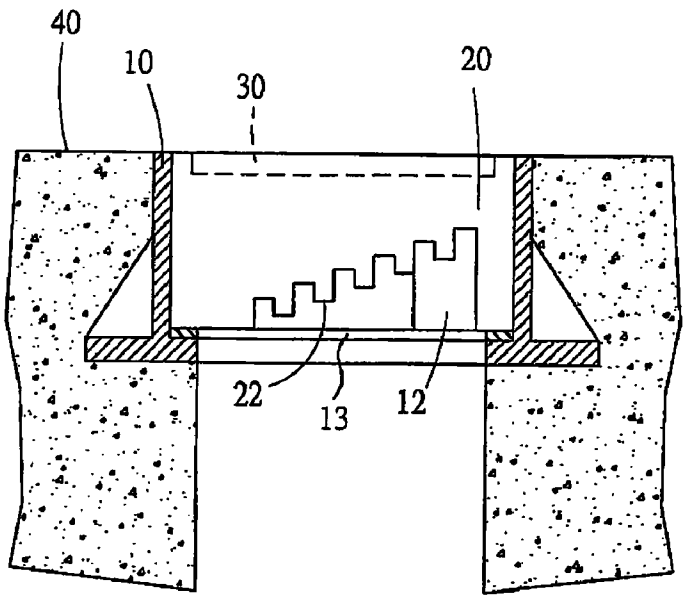

Referring to FIG. 8, when practically applying the present invention that is implemented to the manhole cover 30, a top surface of the manhole cover 30 should be at the same level as the pavement 40; in the mean time, a tolerance of difference in height should not exceed a certain range. Once the pavement 40 is patched and re-paved (as shown in FIG. 9), a difference in height between the new pavement 40' and the manhole cover 30 will usually be larger than the allowable tolerance. At this time, it only needs to lift up the inner frame 20, allowing the top surface of the cover 30 to be at same height as the new pavement 40'. In addition, by latching the first type retainers 12 with the second type retainers 22 for positioning, the cover 30 can be fixed at the same height as the new pavement 40'.

Accordingly, through a simple rotation, a quick ascending or descending fine-adjustment operation can be achieved. Furthermore, the existing manhole cover can be combined with the present invention for use, so as to achieve a manhole cover structure which can be finely and quickly adjusted, without replacing a new manhole cover.

Figure 10A:
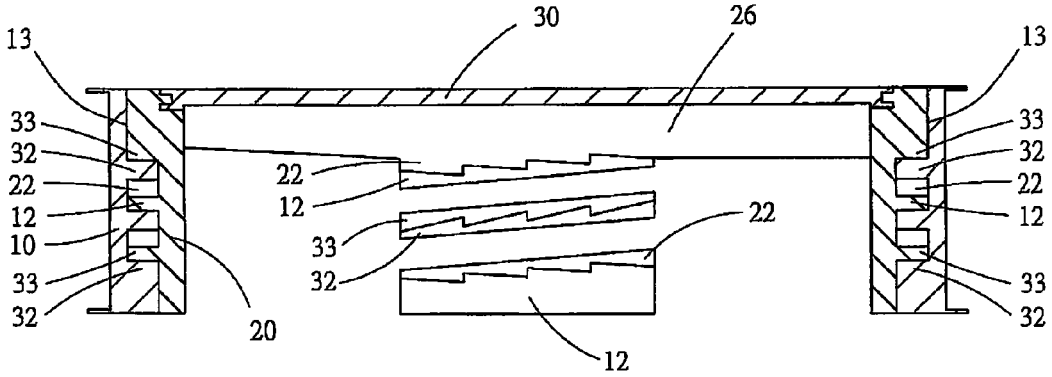
FIGS. 10A to 10C show cutaway views of a saw-tooth design and an ascending or descending operation, of first retainers and second retainers, according to the present invention.
Figure 10B:
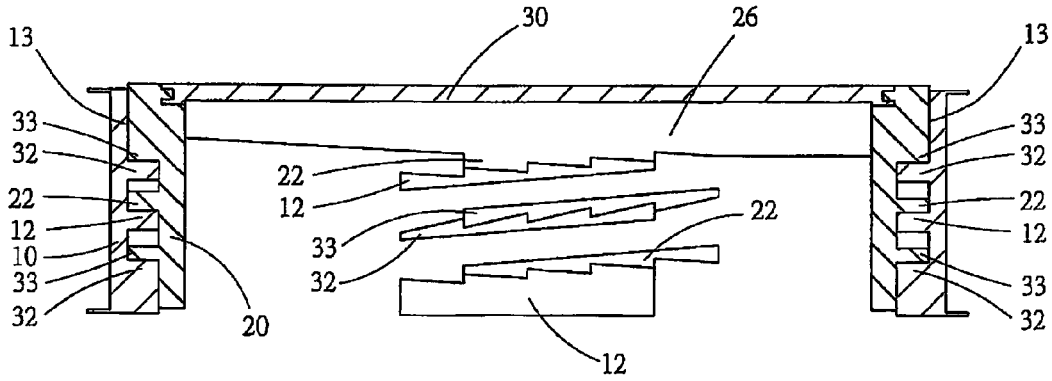
Figure 10C:
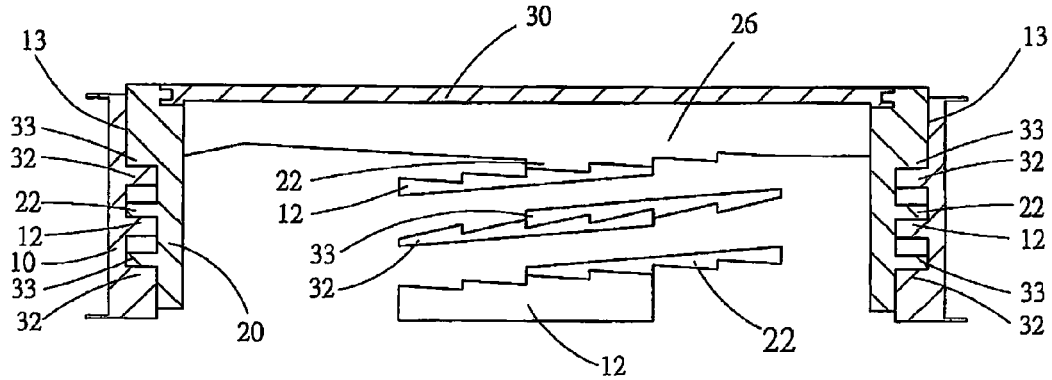

Referring to FIGS. 10A to 10C, it shows the cutaway views of the fourth embodiment of the present invention, wherein the inner frame 20 is ascending or descending within the outer frame 10. As shown in the drawings, the first type retainers 12 and the second type retainers 22 are manifested as another implementation configuration. The first type retainers 12 manifest primarily a saw-tooth design and the second type retainers 22 also manifest a saw-tooth design corresponding to the first type retainers; whereas, the third type retainers 32 and the fourth type retainers 33 manifest an oppositely arranged saw-tooth design. As a result, a reaction force is generated at the first and second type retainers to prevent from sliding and to form a finely adjusted ascending or descending operation to the inner frame 20 of a manhole seat; that is, a single-rail snap is formed by latching the first type retainers 12 with the second type retainers 22, thereby achieving a positioning effect. In particular, all of the first type retainers 12 and the second type retainers 22 manifest a slope configuration, allowing the inner frame 20 of the manhole seat to ascend or descend in fine adjustment within the outer frame 10 of the manhole seat by rotation.

As the height of the second type retainer 22 does not exceed a proper height of the whole wall, an upper part will form a sealed state between a shield wall 26 and the outer frame 10 to prevent water and mud from coming in.

Referring to FIG. 10A, when the first type retainers 12 are completely latched with the second type retainers 22, the manhole cover 30 is at the same level with the outer frame 10 and the inner frame 20 of the manhole seat.

When the height of the manhole cover 30 is to be adjusted, it only needs to rotate the inner frame 20, allowing the first type retainers 12 to be latched with the second type retainers 22 by a three-quarter of area, as shown in FIG. 10B, so as to achieve a finely adjusted ascending or descending operation. On the other hand, as the inner frame 20 and the outer frame 10 are assembled together by latching the first type retainers 12 with the second type retainers 22, when adjusting the height, it only needs to rotate the inner frame 20 directly so that the fine adjustment operation can be achieved.

Besides, if the height of the cover 30 is adjusted to a higher position, then it only needs to rotate the inner frame 20 further, allowing the first type retainers 12 to be latched with the second type retainers 22 by a half of area, as shown in FIG. 10C, so as to increase a height difference between the cover 30 and the outer frame 10.

As a result, through a simple rotation operation, a quick ascending or descending fine adjustment operation can be achieved. Furthermore, the existing manhole cover can be combined with the present invention for use, so as to achieve a manhole cover structure which can be finely and quickly adjusted.

Figure 11A:
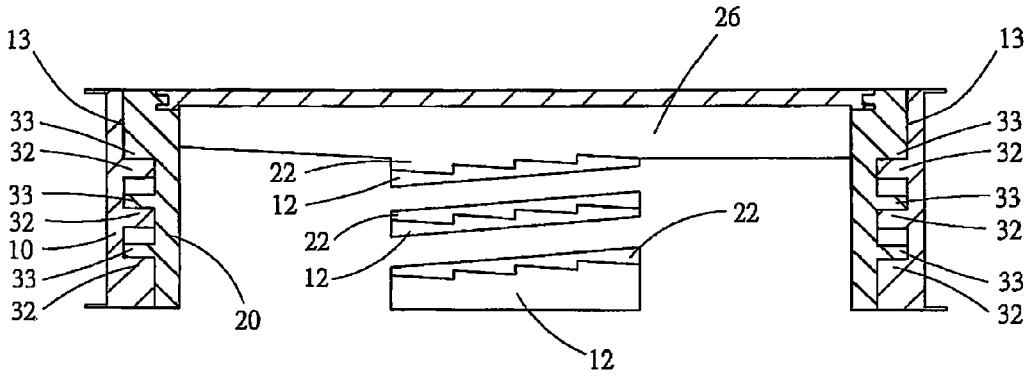
FIGS. 11A to 11C show cutaway view of a saw-tooth design of first retainers and second retainers which are arranged oppositely and ascending or descending, according to the present invention.
Figure 11B:
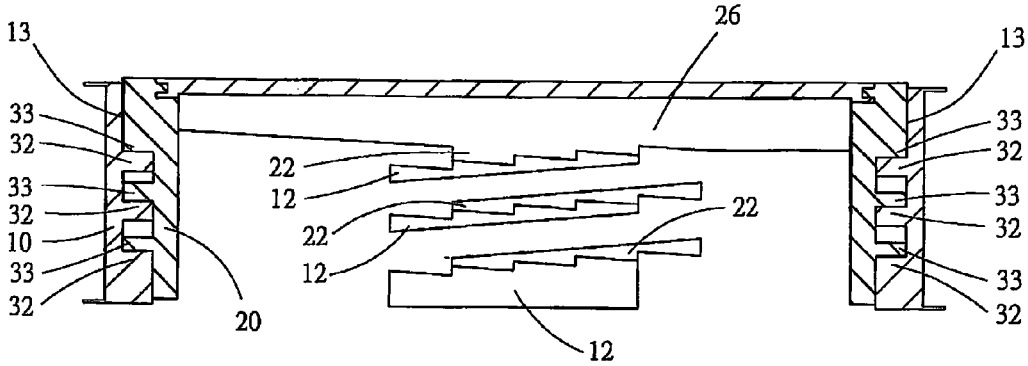
Figure 11C:
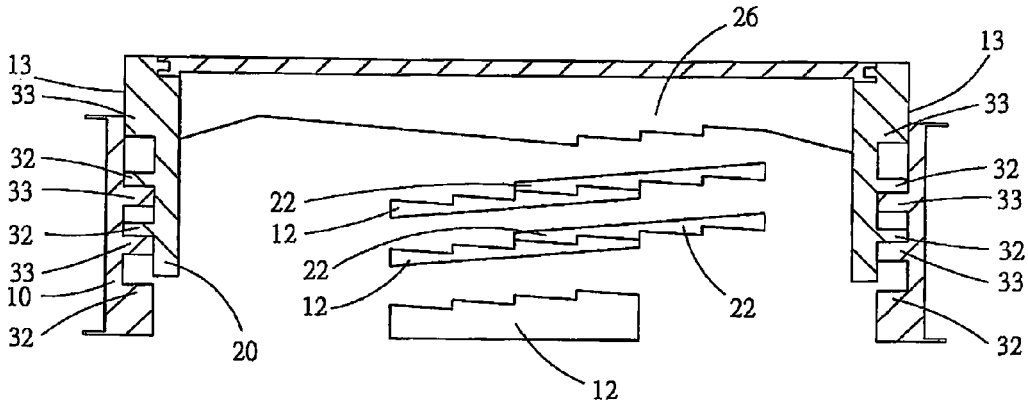

Referring to FIGS. 11A to 11C, it shows schematic views of an ascending or descending operation of the fifth embodiment of the present invention. As shown in the drawings, the saw-tooth design of the first type retainers 12 in the outer frame 10 can be arranged oppositely, whereas the second type retainers 22 on the inner frame 20 correspond to the first type retainers 12, such that through the opposite arrangement of the first type retainers 12 and the second type retainers 22 relative to the third type retainers 32 and the fourth type retainers 33, the inner frame 20 can be more stably latched with the outer frame 10, thereby preventing from slipping off.

Figure 12:
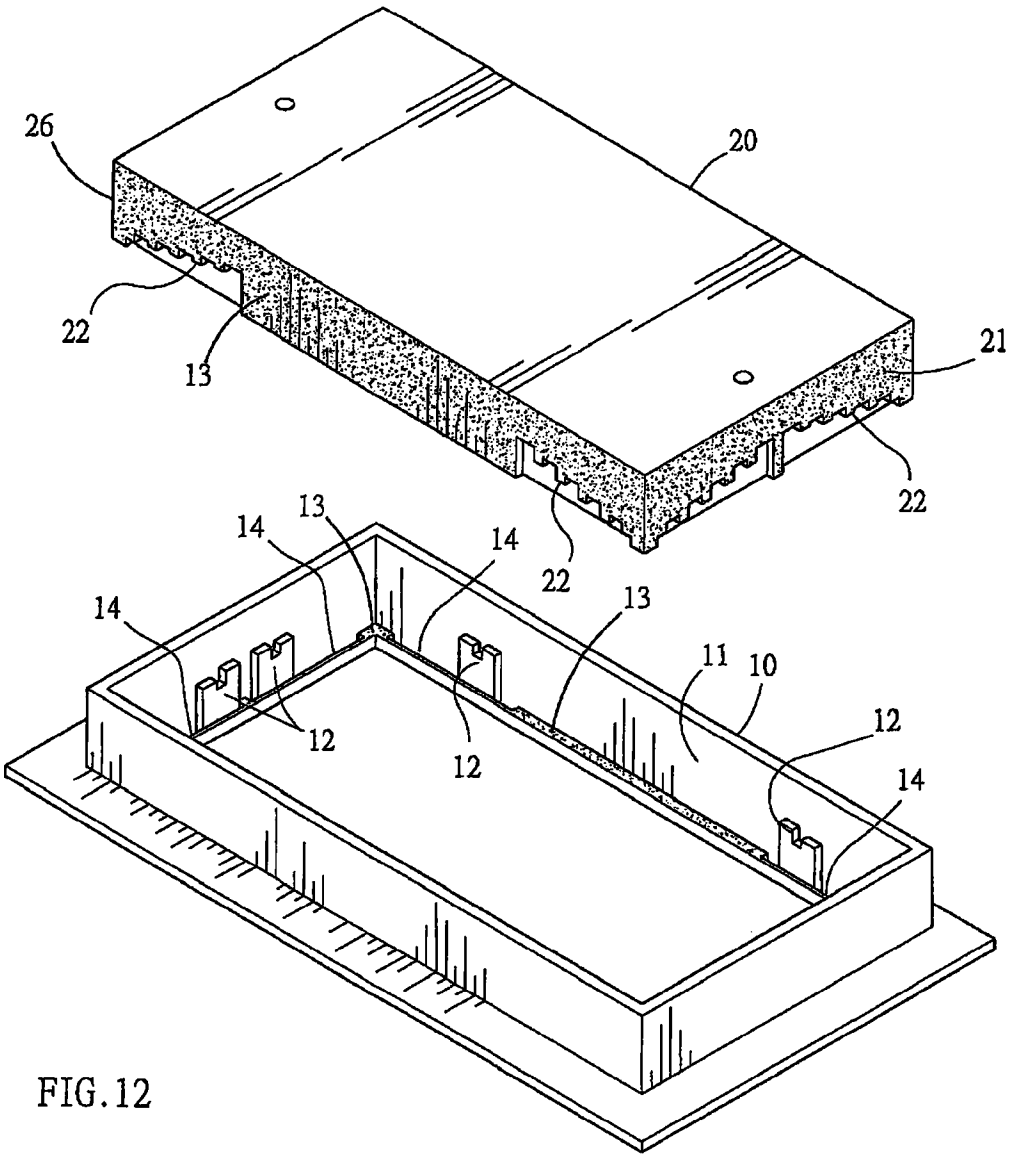
FIG. 12 shows a three-dimensional exploded view of the present invention applying to a rectangular manhole cover.

On the other hand, referring to FIG. 12, it shows a schematic view of the sixth embodiment of the present invention. When the present invention is applied to a rectangular manhole cover, the outer frame 10 and the inner frame 20 are in a rectangular shape and the first type retainers 12 on the outer frame 10 are made to slide with respect to the outer frame 10, primarily through providing plural sliding slots 14 on the outer frame 10. Therefore, the first type retainers 12 can move transversally toward left or right on the outer frame 10 through the sliding slots 14, so that by collaborating with the second type retainers 22 on the inner frame 20, the inner frame 20 can be expandable by ascending or descending on the outer frame 10.

In addition, the maximum height of the first type and second type retainers does not exceed a proper size of a full height of the wall, and reserved portions will constitute the shield wall 26, keeping a space between the outer frame 10 and the inner frame 20 at a sealed state; that is, water and mud can be prevented from coming in. Moreover, the side wall 11 or 21 and the bottom seat are additionally provided with the pad 13 to block noise and to seal.

Figure 13:
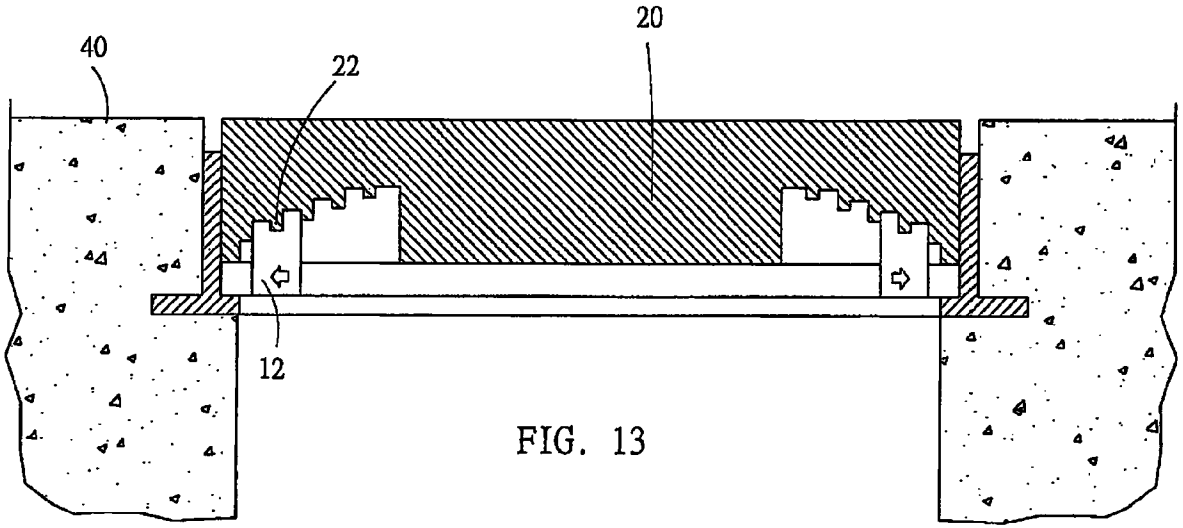
FIGS. 13 to 15 show cutaway views of the present invention which is applied to a rectangular manhole cover, disclosing conditions of adjustment.
Figure 14:
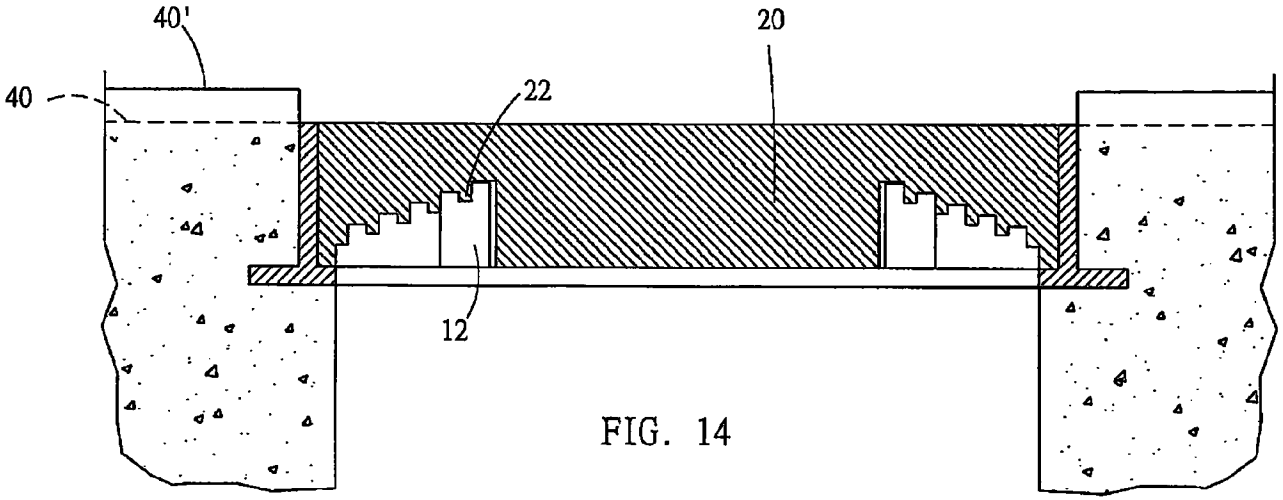
Figure 15:
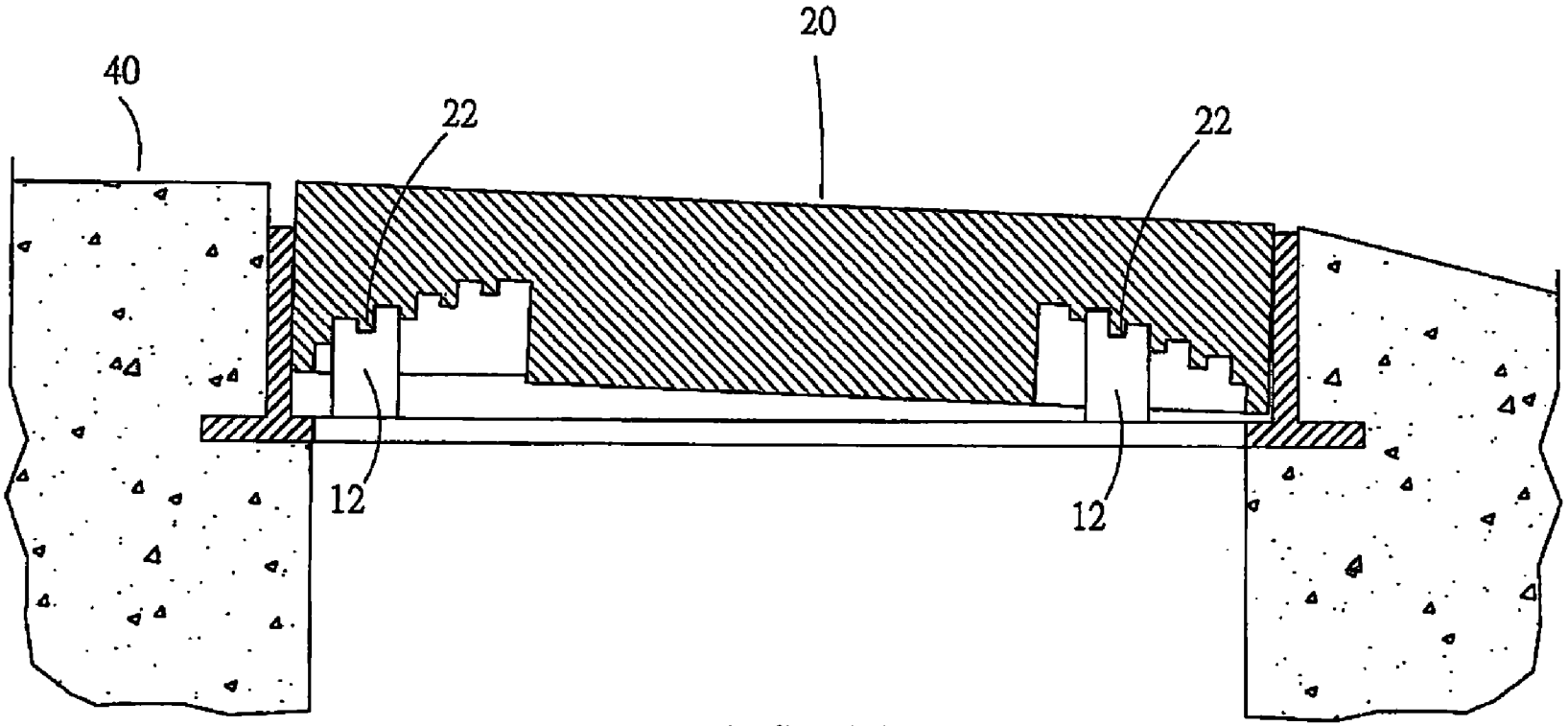

Referring to FIG. 13 and FIG. 14, when the present invention is applied to a rectangular manhole cover, it only needs to move the first type retainers 12 that a relative height of the inner frame 10 can be adjusted. It is worthy of mentioning that four edges of the rectangular outer frame 10 are all provided with the movable first type retainers 12. When the first type retainers 12 at the front and rear edges are assembled respectively with the second type retainers 22 of different heights, the inner frame 20 will be tilted forward or backward. Whereas, when the first type retainers 12 at the left and right edges are assembled respectively with the second type retainers 22 of different heights, the inner frame 20 will be tilted leftward or rightward. This feature can be adjusted properly for a rough pavement (as shown in FIG. 15).

Finally, referring to FIG. 16, it shows a schematic view of the present invention which is applied to a circular manhole cover, allowing the manhole cover to be tilted.

As shown in the drawing, when the present invention is applied to the circular manhole cover, an upper end of one or plural first type retainers 12 of the outer frame 10 is provided with a height extender 15 by which the inner frame 20 is tilted by an angle (as shown in the dotted line) within the outer frame 10 when the inner frame 20 is assembled with the outer frame 10 through the first type retainers 12 and the second type retainers 22.

However, as the manhole cover 30 is provided on the inner frame 20, the manhole cover 30 is also titled by an angle along with the inner frame 20 and this feature can allow the circular manhole cover to be adjusted properly for a rough pavement.

Figure 17:
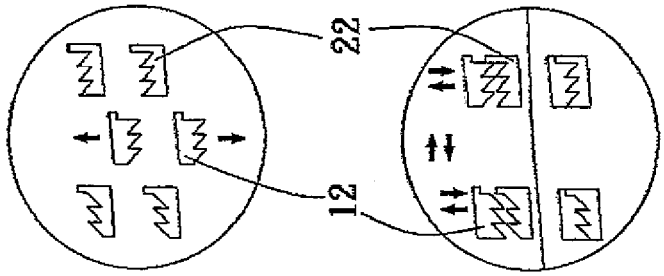
FIG. 17 shows a schematic view of the present invention which is applied to an anti-looseness screw structure.
Figure 17:
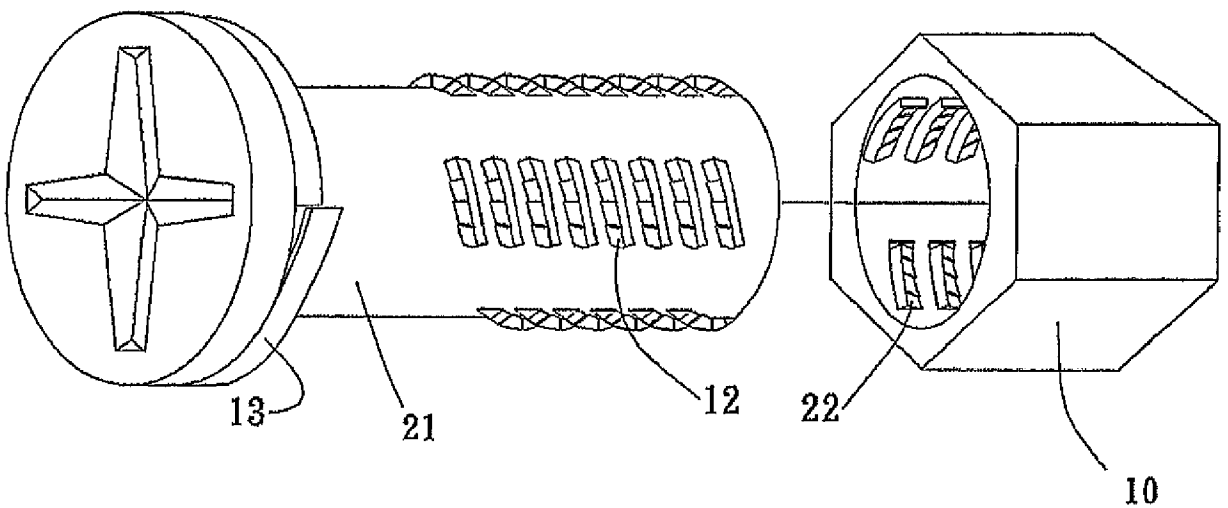

Referring to FIG. 17, it shows a schematic view of the present invention which is applied to an anti-looseness screw structure, wherein a front end of a side wall 21 of a screw is provided with a washer 13, and the side wall 21 is arranged with first type retainers 12 which are latched with second type retainers 22 on an inner wall of a nut (outer frame 10); the latching can be disclosed from an exploded view of operations of installing, dismantling and anti-loosening to a right side of the drawing.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An adjustable expandable installment comprising an outer frame, which is a hollow tube and the inner wall of the outer frame is provided with plural first type retainers being arranged obliquely from low to high; and an inner frame is emplaced in the interior of the outer frame and the outer wall rim of the inner frame is provided with second type retainers arranged in a continuous helix completely encircling a circumference of the inner frame, the second type retainers corresponding to the first type retainers.

2. The adjustable expandable installment according to claim 1, wherein the first type retainers and the second type retainers are in a geometrical shape that the retainers are latched together to form a stable latching without any fixing accessories.

3. The adjustable expandable installment according to claim 1, the first type retainers and the second type retainers arranged from the top to the bottom of the outer frame and the inner frame, respectively.

4. The adjustable expandable installment according to claim 1, the helix extending continuously downward on the inner frame.

5. The adjustable expandable installment according to claim 1, wherein at least one of the first type retainers has a j shape and wherein the second type retainers have a plurality of notches for receiving an upwardly extending portion of the at least one first type retainer in order to lock the installment in place.

6. An adjustable expandable installment comprising an outer frame, which is a hollow tube and the inner wall of the outer frame is provided with plural first type retainers being arranged obliquely from low to high; an inner frame is emplaced in the interior of the outer frame and the outer wall rim of the inner frame is provided with second type retainers arranged in a continuous helix completely encircling a circumference of the inner frame, the second type retainers corresponding to the first type retainers; and a cover which is provided above the inner frame.

7. The adjustable expandable installment according to claim 6, wherein a pad is further provided between the inner frame and the outer frame.

8. The adjustable expandable installment according to claim 6, wherein between the cover and the inner frame and below the cover are provided additionally with a pad to block noise and to seal.

9. The adjustable expandable installment according to claim 6, wherein the first type retainers and the second type retainers are in a geometrical shape that the retainers are latched together to form a stable latching without any fixing accessories.

10. The adjustable expandable installment according to claim 6, the first type retainers and the second type retainers arranged from the top to the bottom of the outer frame and the inner frame, respectively.

11. The adjustable expandable installment according to claim 6, the helix extending continuously downward on the inner frame.

12. The adjustable expandable installment according to claim 6, wherein at least one of the first type retainers has a j shape and wherein the second type retainers have a plurality of notches for receiving an upwardly extending portion of the at least one first type retainer in order to lock the installment in place.

13. An adjustable expandable installment comprising an outer frame, the inner wall of which is provided with plural first type retainers being fixed at it; an inner frame, which is provided in the interior of the outer frame and the exterior rim of which is provided with plural second type retainers being arranged from high to low and corresponding to the first type retainers, with the inner frame being expandable from ascending or descending by changing positions of the first or second type retainers; and a cover which is provided above the inner frame.

* * * * *